US008028752B2

(12) United States Patent
Richards

(10) Patent No.: US 8,028,752 B2
(45) Date of Patent: Oct. 4, 2011

(54) PLUG SETTING AND RETRIEVING APPARATUS

(75) Inventor: Andrew Richards, Aberdeenshire (GB)

(73) Assignee: Expro North Sea Limited (GB)

( * ) Notice: Subject to any disclaimer, the term of this patent is extended or adjusted under 35 U.S.C. 154(b) by 1029 days.

(21) Appl. No.: 11/568,221

(22) PCT Filed: Apr. 19, 2005

(86) PCT No.: PCT/GB2005/001484

§ 371 (c)(1),
(2), (4) Date: Jul. 17, 2007

(87) PCT Pub. No.: WO2005/103442

PCT Pub. Date: Nov. 3, 2005

(65) Prior Publication Data

US 2007/0289745 A1 Dec. 20, 2007

(30) Foreign Application Priority Data

Apr. 24, 2004 (GB) ..... 0409189.8

(51) Int. Cl.
*E21B 33/12* (2006.01)
*E21B 23/00* (2006.01)

(52) U.S. Cl. ..... 166/339; 166/343; 166/368; 166/386; 166/85.1; 166/192; 166/181

(58) Field of Classification Search ..... 166/337, 166/339, 335, 368, 192, 116, 135, 86.1, 381, 166/386, 77.1, 77.2, 85.1, 123, 125, 181, 166/343

See application file for complete search history.

(56) References Cited

U.S. PATENT DOCUMENTS

| | | | | | |
|---|---|---|---|---|---|
| 3,242,991 | A | * | 3/1966 | Johnson et al. | 166/352 |
| 3,252,515 | A | * | 5/1966 | Donaldson et al. | 166/114 |
| 3,554,281 | A | * | 1/1971 | Ecuer | 166/155 |
| 3,556,212 | A | * | 1/1971 | Vazquez et al. | 166/72 |
| 3,580,332 | A | * | 5/1971 | Dean et al. | 166/184 |
| 4,047,566 | A | * | 9/1977 | Duke | 166/285 |
| 4,164,980 | A | * | 8/1979 | Duke | 166/291 |
| 4,503,879 | A | | 3/1985 | Lazarus et al. | |
| 4,522,259 | A | * | 6/1985 | Akkerman | 166/237 |

(Continued)

FOREIGN PATENT DOCUMENTS

EP 1 233 145 8/2002

(Continued)

*Primary Examiner* — Thomas Beach
*Assistant Examiner* — Matthew Buck
(74) *Attorney, Agent, or Firm* — Myers Bigel Sibley & Sajovec, P.A.

(57) ABSTRACT

This invention relates to apparatus for setting a plug in, or retrieving a plug from, a horizontal xmas tree. The apparatus comprises a housing with a throughbore adapted to be releasably connected at a first end to a horizontal xmas tree, the housing including an at least one axially moveable member which also includes an at least one radially moveable element and a tool deployable within the housing throughbore by an elongate support and adapted to be releasably connected to the plug. The tool has an outer surface portion profiled to releasably engage with an engagement surface the at least one radially moveable element whereby, in operation, engagement of the at least one radially moveable element with the tool outer surface portion permits the plug, connected to the tool, to be set in the horizontal xmas tree or retrieved from the horizontal xmas tree by axial movement of the at least one axially moveable member.

17 Claims, 2 Drawing Sheets

U.S. PATENT DOCUMENTS

| | | | | | |
|---|---|---|---|---|---|
| 4,651,818 | A | * | 3/1987 | Johnson et al. | 166/115 |
| 4,804,045 | A | | 2/1989 | Reed et al. | |
| 5,020,597 | A | * | 6/1991 | Braddick et al. | 166/291 |
| 5,542,475 | A | * | 8/1996 | Turner et al. | 166/387 |
| 5,566,772 | A | * | 10/1996 | Coone et al. | 175/321 |
| 5,787,979 | A | * | 8/1998 | Giroux et al. | 166/177.4 |
| 5,868,204 | A | * | 2/1999 | Pritchett et al. | 166/368 |
| 5,884,706 | A | * | 3/1999 | Edwards | 166/335 |
| 5,988,277 | A | * | 11/1999 | Vick et al. | 166/123 |
| 5,988,282 | A | * | 11/1999 | Jennings et al. | 166/348 |
| 5,996,697 | A | * | 12/1999 | Vick et al. | 166/386 |
| 6,050,339 | A | * | 4/2000 | Milberger | 166/368 |
| 6,076,605 | A | * | 6/2000 | Lilley et al. | 166/368 |
| 6,367,551 | B1 | * | 4/2002 | Fenton | 166/345 |
| 6,547,008 | B1 | * | 4/2003 | Hopper et al. | 166/348 |
| 6,547,009 | B2 | * | 4/2003 | Vick, Jr. | 166/368 |
| 6,719,059 | B2 | * | 4/2004 | Dezen et al. | 166/368 |
| 6,810,954 | B2 | * | 11/2004 | Garrett et al. | 166/77.51 |
| 7,025,132 | B2 | * | 4/2006 | Kent et al. | 166/87.1 |
| 7,069,988 | B2 | * | 7/2006 | Bartlett et al. | 166/86.2 |
| 7,128,157 | B2 | * | 10/2006 | Hoffman et al. | 166/305.1 |
| 7,143,830 | B2 | * | 12/2006 | Bartlett | 166/339 |
| 2003/0019632 | A1 | * | 1/2003 | Humphrey et al. | 166/368 |

FOREIGN PATENT DOCUMENTS

| | | | |
|---|---|---|---|
| GB | 2295171 | A | 5/1996 |

* cited by examiner

PLUG SETTING AND RETRIEVING APPARATUS

CROSS REFERENCE TO RELATED APPLICATIONS

This application claims priority from PCT Application PCT/GB2005/001484, filed 19 Apr. 2005, which claims priority from British Application No. 0409189.8, filed 24 Apr. 2004. These disclosures are hereby incorporated by reference herein in their entireties.

FIELD OF THE INVENTION

This invention relates generally to oil and gas production wells and, more particularly, to methods of setting a plug in or retrieving a plug from a horizontal xmas tree used in oil and gas production wells.

BACKGROUND OF THE INVENTION

Subsea oil and gas production wells are sealed off from the environment using apparatus known as a production xmas trees. Two types are commonly used; firstly the vertical xmas tree, which has gate valves in the production bore allowing isolation of the well through the remote operation of these valves, and secondly, the horizontal or "spool" xmas tree in which the production bore is sealed off using plugs run into a tubing hanger installed inside the tree.

Increasingly, horizontal type xmas trees are being used with subsea wells for reasons of cost and convenience. Horizontal xmas trees allow wells to be brought into production in less time and at a lower cost than vertical xmas trees. Furthermore, horizontal xmas trees allow for more modern and larger bore completion systems to be used in the well.

However, significant problems have been encountered when trying to correctly set plugs in the tree, or when trying to recover plugs from the tree. For example, the plug can be set in similar, but incorrect profiles within the tree resulting in low integrity sealing of the well. Secondly large forces are required to set or retrieve the plug from the tree, and thirdly there is no positive indication of the plug being correctly set.

Since the plugs are primary barriers in isolating the high pressure hydrocarbon well fluids from the environment, it is critical they are correctly placed and fitted within the xmas tree system.

SUMMARY OF THE INVENTION

It is an object of embodiments of the present invention to obviate or mitigate at least one of the aforementioned problems with the prior art.

According to a first aspect of the present invention there is provided apparatus for setting a plug in, or retrieving a plug from a horizontal xmas tree the apparatus comprising:

a housing adapted to be releasably connected at a first end to a horizontal xmas tree, the housing having a throughbore and including an at least one axially moveable member, the at least one axially moveable member including an at least one radially movable element, the at least one radially movable element having an engagement surface, and a tool adapted to be deployed within the housing throughbore by an elongate support and adapted to be releasably connected to a plug, the tool having an outer surface, a portion of the tool outer surface being profiled to releasably engage with the engagement surface of the at least one radially moveable element;

wherein, engagement of the engagement surface of the at least one radially moveable element with the tool outer surface portion, permits a plug, connected to the tool, to be set in the horizontal xmas tree or retrieved from the horizontal xmas tree by axial movement of the at least one axially moveable member.

The apparatus permits sufficient force to be applied to the plug to set the plug in position in the horizontal xmas tree, or to remove the plug from the horizontal xmas tree, without putting undue load or stress on the elongate support member.

Preferably, in use, the distance between the tool outer surface portion and the plug is a fixed length.

If the distance between the tool outer surface portion and the plug is a fixed length, then displacing the at least one axially moveable member a known distance will, in turn, displace the plug the same known distance. This will give an operator control over how far the plug is moved, which is particularly useful when setting the plug in the correct position in the horizontal xmas tree.

Most preferably the tool includes a tool land and the housing includes a housing land, the tool land adapted to engage with the housing land on deployment of the tool into the housing throughbore. Conveniently the housing land is mounted on the at least one radially moveable element.

When the tool is deployed in the housing, the engagement of the tool land with the at least one radially moveable element land ensures the tool and the housing are in a known position with respect to each other. If the tool and the housing are in a known position with respect to each other the exact distance the at least one axially moveable member needs to be moved to set or retrieve the plug may be calculated.

Preferably, the at least one axially moveable member is axially displaced by hydraulic means. Alternatively, the at least one axially moveable member is axially displaced by mechanical, electrical or electro-hydraulic means.

Preferably, the at least one radially moveable element is radially displaced by hydraulic means. Alternatively, the at least one radially moveable element is radially displaced by mechanical, electrical or electro-hydraulic means.

It should be appreciated that any other suitable means as would readily be selected by a person of ordinary skill in the art may be used to axially displace the at least one axially moveable member or radially displace the at least one radially moveable element.

Preferably, the apparatus may be operated remotely.

As horizontal xmas trees are generally used on the seabed the ability to operate the apparatus remotely is essential.

Preferably, the apparatus includes an override permitting operation by a remotely operated vehicle.

When remote operation fails, an override is necessary to allow the apparatus to be activated on the seabed.

Preferably, the tool is deployed by wireline. Alternatively, the tool is deployed by slickline or coiled tubing or any other known method of deploying tools downhole.

The apparatus will be of most benefit with forms of deployment to which sufficient force to adequately set or remove a plug can not be applied without the risk of damage to the deployment means.

Preferably, the tool is adapted to be releasably connected to a plug by means of a standard wireline plug-retrieving tool.

Preferably, the housing is adapted to be connected at a second end to a conventional landing string. Alternatively, the housing is adapted to be connected at a second end to a subsea lubricator section or the like.

According to a second aspect of the present invention there is provided a housing adapted to be releasably connected at a first end to a horizontal xmas tree, the housing having:

a throughbore, and an at least one axially moveable member, the at least one axially moveable member including an at least one radially movable element, the at least one radially movable element having an engagement surface, adapted to releasably engage with a complementary outer surface portion of a tool deployable within the housing throughbore.

Preferably, the housing includes a housing land, adapted to engage with a tool land on deployment of the tool into the housing throughbore. Conveniently the housing land is mounted on the at least one radially moveable element.

Preferably, the at least one axially moveable member is axially displaced by hydraulic means. Alternatively, the at least one axially moveable member is axially displaced by mechanical, electrical or electro-hydraulic means.

Preferably, the at least one radially moveable element is radially displaced by hydraulic means. Alternatively, the at least one radially moveable element is radially displaced by mechanical, electrical or electro-hydraulic means.

It should be appreciated that any other suitable means as would readily be selected by a person of ordinary skill in the art may be used to axially displace the at least one axially moveable member, or radially displace the at least one radially moveable element.

Preferably, the at least one axially moveable member may be operated remotely.

Preferably, the at least one radially moveable element may be operated remotely.

Preferably, the housing includes an override permitting operation of the at least one axially moveable member or the at least one radially moveable element or both by a remotely operated vehicle.

Preferably, the housing is adapted to be connected at a second end to a conventional landing string. Alternatively, the housing is adapted to be connected at a second end to a subsea lubricator section or the like.

According to a third aspect of the present invention there is provided a tool adapted to be deployed within a housing throughbore by an elongate support and adapted to be releasably connected to a plug, the tool having:

an outer surface, a portion of the tool outer surface being profiled to be releasably connected with a complementary engagement surface of an at least one radially moveable element.

Preferably, the tool is deployable by wireline. Alternatively, the tool is deployable by slickline or coiled tubing or any other known method of deploying tools downhole.

Preferably, the tool is adapted to be releasably connected to a plug by means of a standard wireline plug-retrieving tool.

According to a fourth aspect of the present invention there is provided a method of setting a plug in a horizontal xmas tree, the method comprising the sequential steps of:

deploying a tool, releasably connected to the plug, within a housing throughbore, the housing releasably connected to a horizontal xmas tree, the housing including an at least one axially moveable member, the at least one axially moveable member including an at least one radially movable element, the element having an engagement surface;

displacing the at least one radially moveable element until the engagement surface releasably engages with outer surface portion of the tool;

displacing the at least one axially moveable member towards the horizontal xmas tree until the plug is located in the correct position within the tree;

disengaging the engagement surface of the at least one radially moveable element from the tool outer surface portion;

disconnecting the tool from the plug, and removing the tool from within the housing throughbore.

According to a fifth aspect of the present invention there is provided a method of retrieving a plug from a horizontal xmas tree, the method comprising the sequential steps of:

deploying a tool within a housing throughbore, the housing releasably connected at a first end to a horizontal xmas tree, the housing including an at least one axially moveable member, the at least one axially moveable member including an at least one radially movable element, the at least one element having an engagement surface;

releasably connecting the tool to the plug to be retrieved from the horizontal xmas tree;

displacing the at least one radially moveable element until the engagement surface releasably engages with an outer surface portion of the tool;

displacing the at least one axially moveable member away from the horizontal xmas tree until the plug is retrieved from the tree;

disengaging the engagement surface of the at least one radially moveable element from the tool outer surface portion, and removing the tool and plug from within the housing throughbore.

By virtue of the present invention a plug can be set in the correct position within a horizontal xmas tree or retrieved from a horizontal xmas tree without putting undue stress on the elongate support.

BRIEF DESCRIPTION OF THE DRAWINGS

These and other aspects of the present invention will now be described, by way of example only, with reference to the accompanying drawings in which.

DETAILED DESCRIPTION OF EMBODIMENTS OF THE INVENTION

Figure 1:
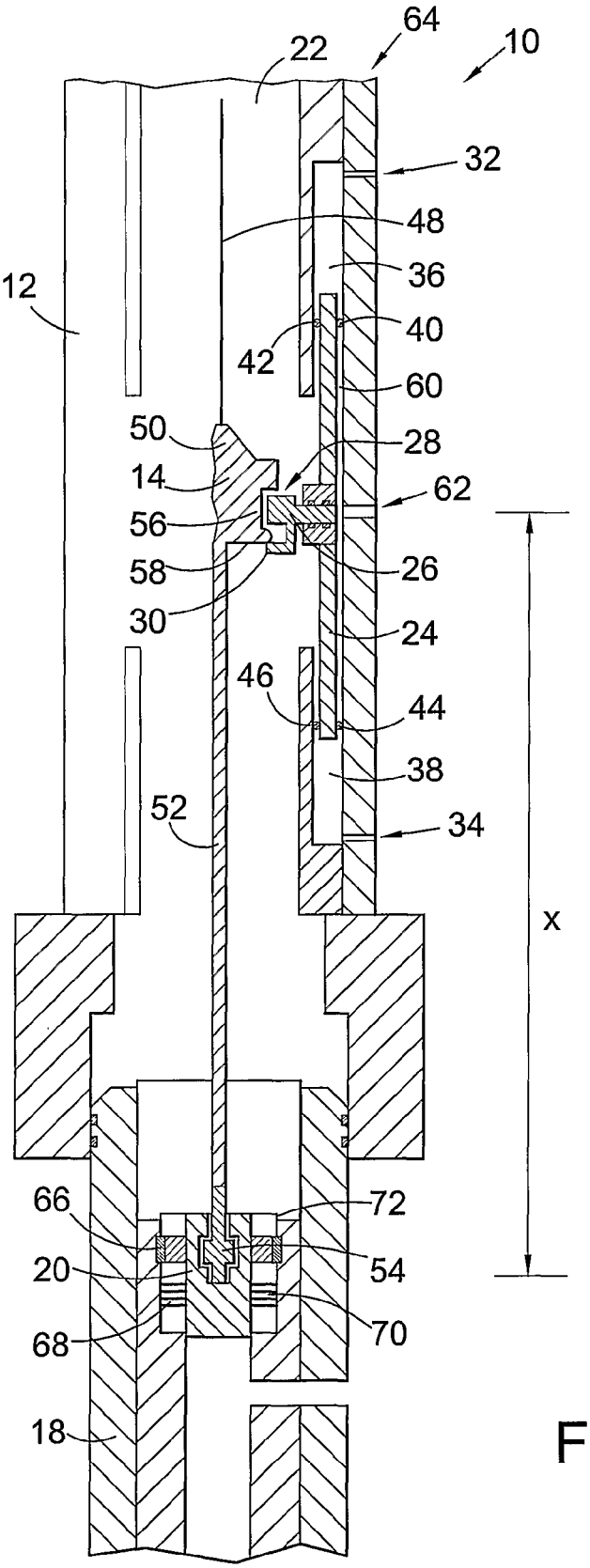
FIG. 1 is a side view of plug setting and retrieval apparatus according to an embodiment of the present invention, the housing shown in section, the tool shown in part section.

Referring first to FIG. 1 there is shown a side view of a plug setting and retrieval apparatus, generally by reference numeral 10, according to an embodiment of the present invention.

The apparatus 10 comprises a housing 12 and a tool 14. The housing 12 is releasably connected by a connector 16 to a horizontal xmas tree 18. The horizontal xmas tree 18 includes a plug 20 which is to be retrieved.

The housing 12 defines a throughbore 22 and includes an axially moveable carriage 24 and four radially moveable engagement rams 26, only one of which is being shown for clarity. The engagement rams 26 each have a profiled surface 28 and a housing land or NOGO 30. The upper end 64 of housing 12 is connected to a subsea lubricator section (not shown) or landing string (not shown).

The carriage 24 is hydraulically activated by introducing or bleeding hydraulic fluid through a first port 32 in to, or out of, an upper chamber 36, and through a second port 34 in to, or out of, a lower chamber 38. The upper chamber 36 is defined by the housing 12, the carriage 24 and a pair of upper seals 40,42. The lower chamber 38 is defined by the housing 12, the carriage 24 and a pair of lower seals 44,46.

The radially moveable engagement rams 26 are also displaced by hydraulic pressure. Hydraulic fluid can be introduced or bled from a middle chamber 60 through a third port 62 to displace the engagement rams 26 either radially inwards towards the centre of the housing throughbore 22 or radially outwards. The middle chamber 60 is defined by the housing 12, the axially moveable carriage 24, the upper outer seal 40 and the lower outer seal 44.

The tool 14 is deployable within the housing throughbore 12 by means of a wireline 48 and the tool 14 comprises a latching tool 50, load-bearing spacer bars 52 and a plug pulling tool 54.

The latching tool 50 includes an outer surface portion 56 profiled to complement, and engage with, the profiled surfaces 28 of the engagement rams 26. The latching tool 50 also includes a tool land, in the form of an annulus shoulder 58, sized to engage with NOGO 30.

The wireline plug pulling tool 54 is shown inserted into the plug 20 in preparation for removal of the plug 20 from the xmas tree 18. The plug 20 is held in place by locating dogs 66 which engage with the xmas tree 18, and the xmas tree 18 is sealed by seals 68 which sit in seal profiles 70.

The use of hydraulic pressure to control the axially moveable carriage 24 allows for accurate measurement of the distance the carriage 24 has been displaced. To remove the plug 20, the carriage 24 is located in the centre of its potential travel, as shown in FIG. 1, by equalising the pressure in the upper chamber 36 and the lower chamber 38. The distance from the engagement rams 26 to the plug 20 (distance X on FIG. 1) is known, and the tool 14 is assembled with the required length of load-bearing spacer bars 52, such that when the tool 14 is run-in, the annular shoulder 58 will engage with the NOGO 30 and the plug pulling tool 54 will engage the plug 20.

Hydraulic fluid is then introduced into the middle chamber 60 through third port 62 to displace the engagement rams 26 towards the tool 14 until the profiled surfaces 28 of the engagement rams 26 engage with the complementary profiled outer surface 56 of the latching tool 50. Hydraulic fluid is then introduced into the lower chamber 38 through the second port 34 and removed from the upper chamber 36 through the first port 32 so that the axially moveable carriage 24 is displaced away from the horizontal xmas tree 18. The hydraulic pressure created in chamber 38 creates an upward force on the plug pulling tool 54 that is sufficient to collapse the plug-locating dogs 66 that hold the plug 20 in place and pull the seals 68 out of the seal profiles 70, thereby moving the plug 20 clear of the horizontal xmas tree 18. This retrieval of the plug is achieved without putting undue stress or load on the wireline 48.

Hydraulic pressure is then released from the middle chamber 60 through port 62 causing the engagement rams 26 to retract and disengage from the latching tool 50 allowing the tool 14 and plug 20 to be retrieved to surface by wireline 48.

Similarly, a plug 20 can be set in the xmas tree by running in a tool 14 with sufficient spacer bars 52 to position the plug 20 slightly above the entrance 72 of the horizontal xmas tree 18 when the annular shoulder 58 engages the NOGO 30. As the distance from the engagement rams 26 to the correct set plug position (indicated by distance X) is known, and the length of tool 14 is known the distance the axially moveable carriage 24 has to be moved when engaged with the tool 14, to correctly set the plug 20 in position, can be calculated.

In this case, to move the plug 20 into position, Hydraulic fluid is then introduced into the middle chamber 60 through third port 62 to displace the engagement rams 26 towards the tool 14 until the profiled surfaces 28 of the engagement rams 26 engage with the complementary profiled outer surface 56 of the latching tool 50. Hydraulic fluid is then introduced into the upper chamber 36 through the first port 32 and removed from the lower chamber 38 through the second port 34 so that the axially moveable carriage 24 is displaced towards the horizontal xmas tree 18. The hydraulic pressure created in chamber 38 is force the plug 20 into the xmas tree 18 allowing the plug-locating dogs 66 to engage the tree 18 and the seals 68 to mate with the seal profiles 70, thereby sealing the horizontal xmas tree 18. This setting of the plug is achieved without putting undue stress or load on the wireline 48.

Hydraulic pressure is then released from the middle chamber 60 through port 62 causing the engagement rams 26 to retract and disengage from the latching tool 50 allowing the tool 14 to be retrieved to surface by wireline 48.

Figure 2:
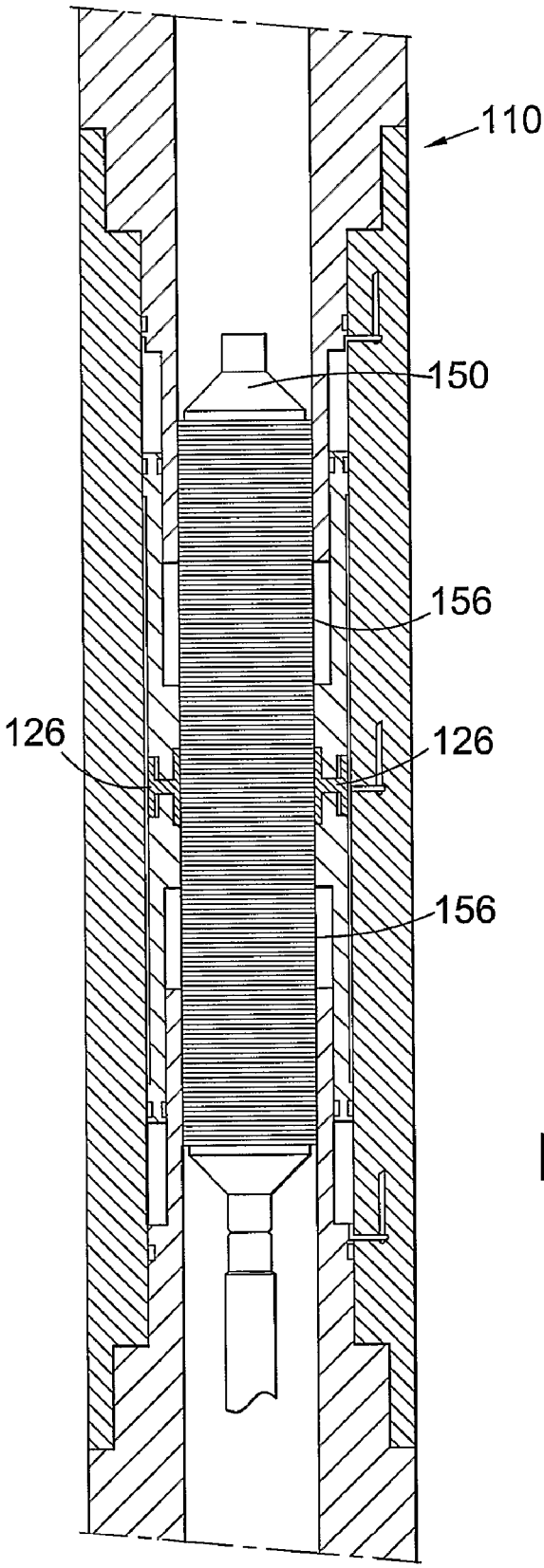
FIG. 2 is a cut away side view of plug setting and retrieval apparatus according to an alternative embodiment of the present invention.

Referring now to FIG. 2, there is shown a cut-away side view of plug setting and retrieval apparatus 110 according to an alternative embodiment of the present invention. In this case, the profiled surface 156 of the latching tool 150 is a roughened surface, which extends along the majority of the length of the latching tool 150. This extended profiled surface 156 allows the radially moveable engagement rams 126 (of which two are shown) to engage the latching tool 150 at any position along its length. This embodiment is suitable for activities where less accuracy in setting and retrieval is necessary.

Various modifications and improvements may be made to the embodiments hereinbefore described without departing from the scope of the invention.

Those of skill in the art will recognise the above-described embodiments of the invention provide a plug setting and retrieval apparatus which permits sufficient force to be applied to a plug to sit the plug in position in a horizontal xmas tree or removed from the horizontal xmas tree without putting undue load or stress on the wireline, slickline or coiled tubing or the like.

What is claimed is:

1. An apparatus for setting a plug in, or retrieving a plug from a horizontal xmas tree the apparatus comprising:

a housing adapted to be releasably connected at a first end to the horizontal xmas tree, the housing having a throughbore and including an at least one axially moveable member, the at least one axially moveable member including an at least one radially movable element, the at least one radially movable element having an engagement surface, and a tool adapted to be deployed within the housing throughbore by an elongate support and adapted to be releasably connected to the plug, the tool having an outer surface, a portion of the tool outer surface being profiled to releasably engage with the engagement surface of the at least one radially moveable element;

wherein, engagement of the engagement surface of the at least one radially moveable element with the tool outer surface portion, permits the plug, connected to the tool, to be set in the horizontal xmas tree or retrieved from the horizontal xmas tree by axial movement of the at least one axially moveable member.

2. The apparatus of claim 1 wherein the distance between the tool outer surface portion and the plug is a fixed length.

3. The apparatus of claim 1 wherein the tool includes a tool land and the housing includes a housing land, the tool land adapted to engage with the housing land on deployment of the tool into the housing throughbore.

4. The apparatus of claim 3 wherein the housing land is mounted on the at least one radially moveable element.

5. The apparatus of claim 1 wherein the at least one axially moveable member is axially displaced by hydraulic means.

6. The apparatus of claim 1 wherein the at least one axially moveable member is axially displaced by mechanical, electrical or electro-hydraulic means.

7. The apparatus of claim 1 wherein the at least one radially moveable element is radially displaced by hydraulic means.

8. The apparatus of claim 1 wherein the at least one radially moveable element is radially displaced by mechanical, electrical or electro-hydraulic means.

9. The apparatus of claim 1 wherein the apparatus is operated remotely.

10. The apparatus of claim 1 wherein the apparatus includes an override permitting operation by a remotely operated vehicle.

11. The apparatus of claim 1 wherein the tool is deployed by wireline.

12. The apparatus of claim 1 wherein the tool is deployed by slickline or coiled tubing.

13. The apparatus of claim 1 wherein the tool is adapted to be releasably connected to the plug by means of a standard wireline plug-retrieving tool.

14. The apparatus of claim 1 wherein the housing is adapted to be connected at a second end to a conventional landing string.

15. The apparatus of claim 1 wherein the housing is adapted to be connected at a second end to a subsea lubricator section.

16. A method of setting a plug in a horizontal xmas tree, the method comprising:

deploying a tool, releasably connected to the plug, within a housing throughbore, the housing releasably connected to the horizontal xmas tree, the housing including an at least one axially moveable member, the at least one axially moveable member including an at least one radially movable element, the element having an engagement surface;

displacing the at least one radially moveable element until the engagement surface releasably engages with an outer surface portion of the tool;

displacing the at least one axially moveable member towards the horizontal xmas tree until the plug is located in the correct position within the tree;

disengaging the engagement surface of the at least one radially moveable element from the tool outer surface portion;

disconnecting the tool from the plug, and removing the tool from within the housing throughbore.

17. A method of retrieving a plug from a horizontal xmas tree, the method comprising:

deploying a tool within a housing throughbore, the housing releasably connected at a first end to the horizontal xmas tree, the housing including an at least one axially moveable member, the at least one axially moveable member including an at least one radially movable element, the at least one element having an engagement surface;

releasably connecting the tool to the plug to be retrieved from the horizontal xmas tree;

displacing the at least one radially moveable element until the engagement surface releasably engages with an outer surface portion of the tool;

displacing the at least one axially moveable member away from the horizontal xmas tree until the plug is retrieved from the tree;

disengaging the engagement surface of the at least one radially moveable element from the tool outer surface portion, and removing the tool and plug from within the housing throughbore.

* * * * *